US005829950A

United States Patent [19]

Alder

[11] Patent Number: 5,829,950

[45] Date of Patent: Nov. 3, 1998

[54] PROCESS AND DEVICE FOR LOADING THE SPOOL PEGS OF A SPOOL RACK

[75] Inventor: Günter Alder, Viersen, Germany

[73] Assignee: Sucker-Muller-Hacoba GmbH & Co., Monchengladbach, Germany

[21] Appl. No.: 718,422

[22] PCT Filed: Feb. 22, 1995

[86] PCT No.: PCT/DE95/00222

§ 371 Date: Oct. 11, 1996

§ 102(e) Date: Oct. 11, 1996

[87] PCT Pub. No.: WO95/25835

PCT Pub. Date: Sep. 28, 1995

[30] Foreign Application Priority Data

Mar. 19, 1994 [DE] Germany ..... 44 09 522.8

[51] Int. Cl.[6] ..... B65G 1/04

[52] U.S. Cl. ..... 414/281; 414/807; 414/331; 414/908; 414/564; 414/273; 364/478.06; 242/533.8; 242/35.5 A

[58] Field of Search ..... 414/273, 274, 414/281, 331, 661, 800, 806, 809, 564, 814, 807, 908, 910, 911, 282; 364/478.02, 478.06; 242/533, 533.8, 35.5 A, 906, 403; 280/167

[56] References Cited

U.S. PATENT DOCUMENTS

| | | | |
|---|---|---|---|
| 4,783,021 | 11/1988 | Nagasawa | 414/331 X |
| 4,988,252 | 1/1991 | Yamamoto et al. | 414/331 |
| 5,091,685 | 2/1992 | Sorensenetal | 414/281 X |
| 5,180,269 | 1/1993 | Nishioka | 414/331 |

FOREIGN PATENT DOCUMENTS

| | | | |
|---|---|---|---|
| 467101 | 6/1991 | European Pat. Off. . | |
| 3244917 | 6/1984 | Germany . | |
| 3538838 | 5/1986 | Germany . | |
| 4013066 | 10/1990 | Germany . | |
| 47208 | 2/1988 | Japan | 414/281 |
| WO90/11956 | 10/1990 | WIPO . | |

*Primary Examiner*—Frank E. Werner
*Attorney, Agent, or Firm*—Herbert Dubno

[57] ABSTRACT

Process for loading spool pegs (10) of a spool rack (11) or the like with full yarn spools (12) set by a loading device (13) onto superimposed horizontally arranged pegs (16) of a transport carriage (15), which is moved by a drive motor (23) on a rail between the loading device (13) and the rack (11) and positioned with a sensor in front of the rack (11) in a predetermined position, wherein the carriage pegs (16) and the pegs (10) of the rack (11) are aligned. In order to avoid time-consuming and complicated setting operations, the process is performed so that the sensor (25) is set at the level of a peg tier (b) of the rack (11), that the travel segments (e.g. x1) of the transport carriage (15) are stored during its travels, that sensor signals triggered by the rack pegs (10) are stored in relation to the travel segments (e.g. x1), and that the transport carriage (15) is steered into its spool transfer position via the stored sensor signals.

8 Claims, 3 Drawing Sheets

PROCESS AND DEVICE FOR LOADING THE SPOOL PEGS OF A SPOOL RACK

CROSS REFERENCE TO RELATED APPLICATIONS

This application is a National Phase application of PCT/DE95/00222 filed 22 Feb., 1995 and based in turn, on German application P 4409522.8 filed 19 Mar., 1994 under the International Convention.

FIELD OF THE INVENTION

The invention relates to a process for loading the spool pegs of a spool rack or the like with full yarn spools, which are set by a loading device onto superimposed horizontal pegs of a transport carriage, which is moved on rails by a drive motor between the loading device and the rack, and is positioned with a sensor in a predetermined position in front of the rack, where the carriage pegs align with the pegs of the rack.

BACKGROUND OF THE INVENTION

Such a process is known from EP 0 467 101 A1. There a control contact assigned to a bottom rail serves for the positioning of the transport carriage and its pegs with respect to the spool pegs of the rack. This control contact is for instance a fastening screw of a toothed rack into which engages a driving pinion driven by a drive motor. With this known process, control contacts and or sensors have to be very finely adjusted to each other, so that the transport carriage stops exactly in the right position in front of the rack, for the alignment of the carriage pegs with the pegs of the rack. Only then it is possible to transfer the full spools from the transport carriage to the rack without problems. Besides in practice it is possible that a one-time adjustment of the transport carriage with respect to the rack is not sufficient. Depending on the construction of the rack and/or it use it can be necessary to change or supervise the setting of the positioning of the transport carriage.

OBJECT OF THE INVENTION

It is therefore the object of the invention to improve a process of the aforementioned kind, so that the time-consuming and complicated setting of the positioning of the transport carriage before and during the course of the process can be avoided.

SUMMARY OF THE INVENTION

This object is achieved by positioning the sensor at the height of one peg level of the rack, that the travel distances of the transport carriage during its movements are stored, that the sensor signals triggered by the rack pegs depending on the travel distance are stored, and that the transport carriage is steered into its spool transfer position by means of these stored signals.

It is important for the invention that the position of the rack pegs be measured automatically and that the transport carriage be steered correspondingly to the results of these measurements. The measurement of the positions of the rack pegs of one peg level can be repeated at any time, in order to detect changes in the position of the rack pegs, such as occur in the case of racks with chains by means of which the spool rows are positioned. The positioning of the vertical spool rows, respectively rack pegs, can be influenced by the flexibility of the chains, respectively by chain elongation. With the process of the invention it becomes possible to repeatedly determine the position of the rack pegs, at short time intervals. It is even possible to check the positioning of the rack pegs simultaneously with a loading process and to compare it with the stored values, in order to be able to make immediate or subsequent corrections. This way the steering of the transport carriage can be influenced immediately, which is of particular interest in the case when during the loading process of a rack the loading is performed with a transport carriage having only one row of carriage pegs and which loads the entire rack in successive rows.

An easy setting of the positioning of the transport carriage with respect to a spool rack is important also when several racks are involved in one operation, wherein the distances between the peg rows are possibly different. Then the process of the invention makes possible a quick and precise check of the positions of the rack pegs and a corresponding steering of the transport carriage.

The carriage pegs have to be aligned not only horizontally with the positions of the rack pegs, but it is also necessary to take into consideration differences in the rail levels and the vertical arrangement of the rack pegs over rail level, as well as racks with staggered spacing. In order to detect vertically different positions of the rack pegs, the process is carried out so that a vertically adjustable sensor of the transport carriage is positioned with respect to a vertical peg row of the rack and is vertically moved, that the sensor signals triggered by the vertical peg row are stored, and that the vertically adjustable carriage pegs are positioned according to stored sensor signals. In this process it is possible to take into consideration different distances between the lowermost peg of a rack row and a reference level, e.g. rail level, in order to vertically adjust the carriage pegs so that they align with the rack pegs.

The invention also relates to a device for loading the spool pegs of a spool rack with full yarn spools by means of a loading device which positions the full spools from a spool supply onto superimposed horizontal pegs of a transport carriage, which is moved on a rail by a drive motor between the loading device and the rack, and which can be positioned with a sensor in front of the rack in a predetermined position, wherein the carriage pegs and the pegs of the rack are mutually aligned. In order to improve this device over the above-described disadvantages of the device known from EP 0 467 101 A1, so that the time-consuming and complicated setting of the device before and during the course of the process can be avoided, the device is built so that the sensor is directed towards the height of one peg level of the rack, that a distance measuring instrument is provided for storing the measurements of the distances travelled by the transport carriage during its movements, that the sensor signals triggered by the pegs of the rack can be stored in relation to the measurement results of the distance measuring instrument, and that the drive motor of the transport carriage is capable to control its spool transfer position depending on the stored sensor signals. Known techniques can be used for the distance measurements, so that the device not only avoids time-consuming and complicated setting work during the horizontal position changes of the rag pegs, but also operates with simple and proven means.

It is advantageous to build the device so that a vertically adjustable sensor is provided on the transport carriage, that the signals of this sensor, triggered by a vertical peg row of the rack, can be stored by an instrument measuring the vertical intervals, and that a servomotor vertically adjusting the carriage pegs can position these pegs depending on the stored sensor signals. Known techniques can be used for measuring the vertical intervals, so that the device not only solves the problem of quickly and repeatedly measuring changes in the vertical intervals or vertical differences in the setting of the rack pegs with respect to their vertical position, but moreover this can be achieved with simple and proven means.

A particularly simple construction of the device is achieved when the vertically adjustable sensor can be commonly adjusted with the carriage pegs by their servomotor. As a result only a single actuation means is required in order to displace the carriage pegs, as well as the sensor.

The device has sufficient precision for instance then when the drive motor and/or the servomotor actuate a high-resolution motion pickup, which is in measuring connection with the distance measuring instrument and/or the vertical interval measuring instrument. Such high-resolution motion pickups are usually incremental pickups which make possible a continuous storage of the measured values, based on their measuring connection with the distance measuring instrument an/or the vertical interval measuring instrument.

In order to perform the loading process with a minimum of steering effort and to adjust the device correspondingly, the device is built so that the distance measuring instrument and/or the vertical interval measuring instrument can be connected to a stored program control. By using the measurement results of the distance measuring instrument and the vertical interval measuring instrument, the loading process is steered by the programs stored in the control in such a manner that the loading takes a minimal time, even when the loading depends on a pattern. It is possible, especially with a continuous measuring connection, that the transport carriages, controlled by a computer, accesses spool rows at various vertical intervals, for instance depending on a warp pattern of the yarns to be taken up from the rack.

It is advantageous when the stored program control is arranged at the loading device. In this case the stored program control can be centrally used for all transport carriages, if one assumes that there is only one loading device. Also when one single loading device is used for several racks, this is the most suitable solution, since the construction expenses are the lowest.

The connection of the stored program control to the distance measuring instrument and/or the vertical interval measuring instrument can be permanent, for instance when the stored program control is arranged on the transport carriage, or when a permanent mechanical or wireless connection is possible between the transport carriage and the stored program control. If this can not be done with simple means, then an exchange between the stored program control, on the one hand, and the two measuring instruments on the other hand, takes place for instance then when the transport carriage is located close to the loading device for the purpose of being loaded.

In order to achieve the most universal use of the device, it is built so that the vertical sensor in its basic position is lower than the lowermost rack peg, and that the lowermost peg of the loading device is a reference point for the vertical adjustability of the sensor. This way the transport carriage can be used for the most various racks, also in connection with loading devices whose pegs are arranged at various vertical distances and/or are adjustable.

BRIEF DESCRIPTION OF THE DRAWING

The above and other objects, features and advantages of the present invention will become more readily apparent from the following description, reference being made to the accompaying drawing in which.

SPECIFIC DESCRIPTION

Figure 1:
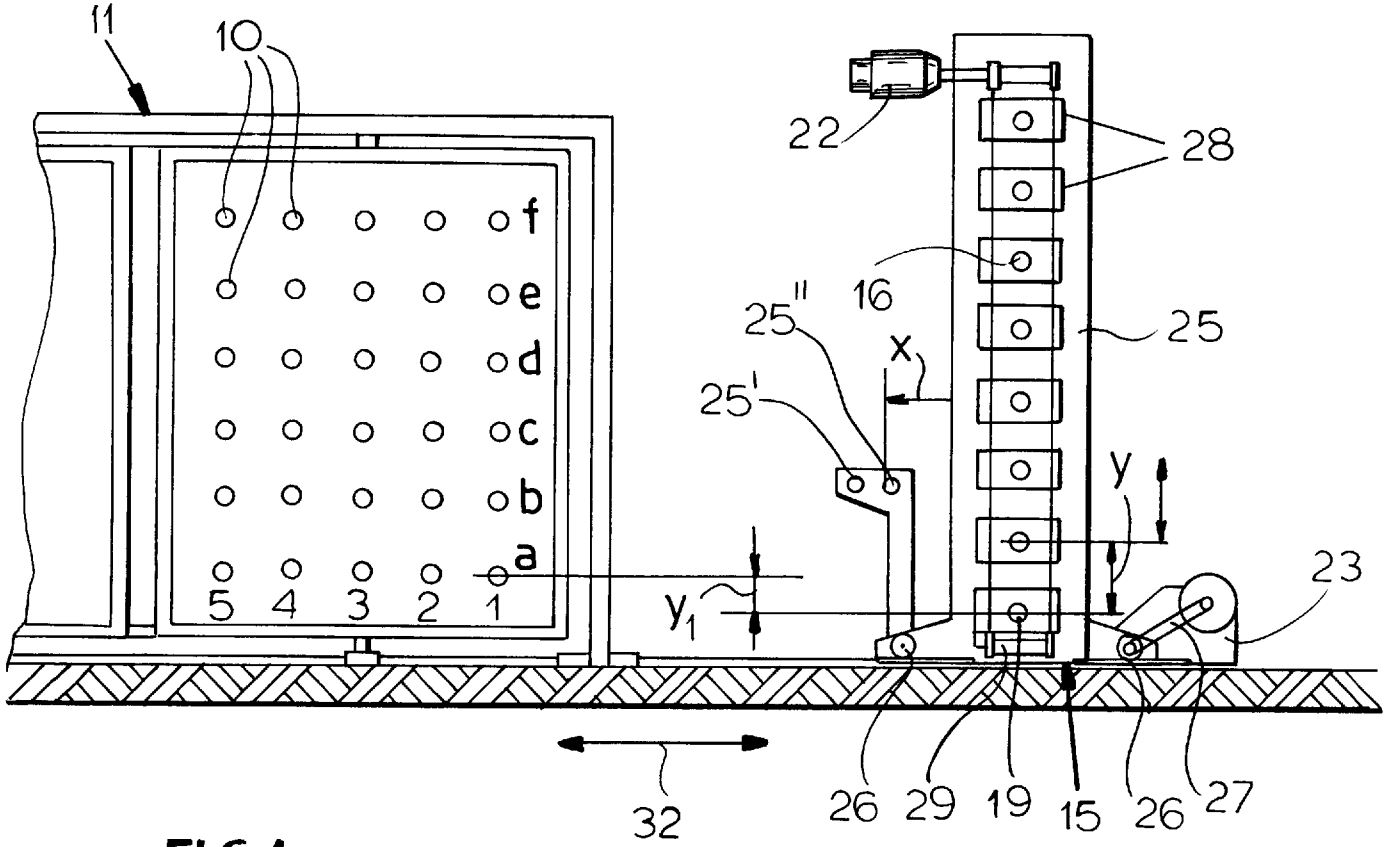
FIG. 1 is a side view of a spool rack and a transport carriage in schematic representation.
Figure 3:
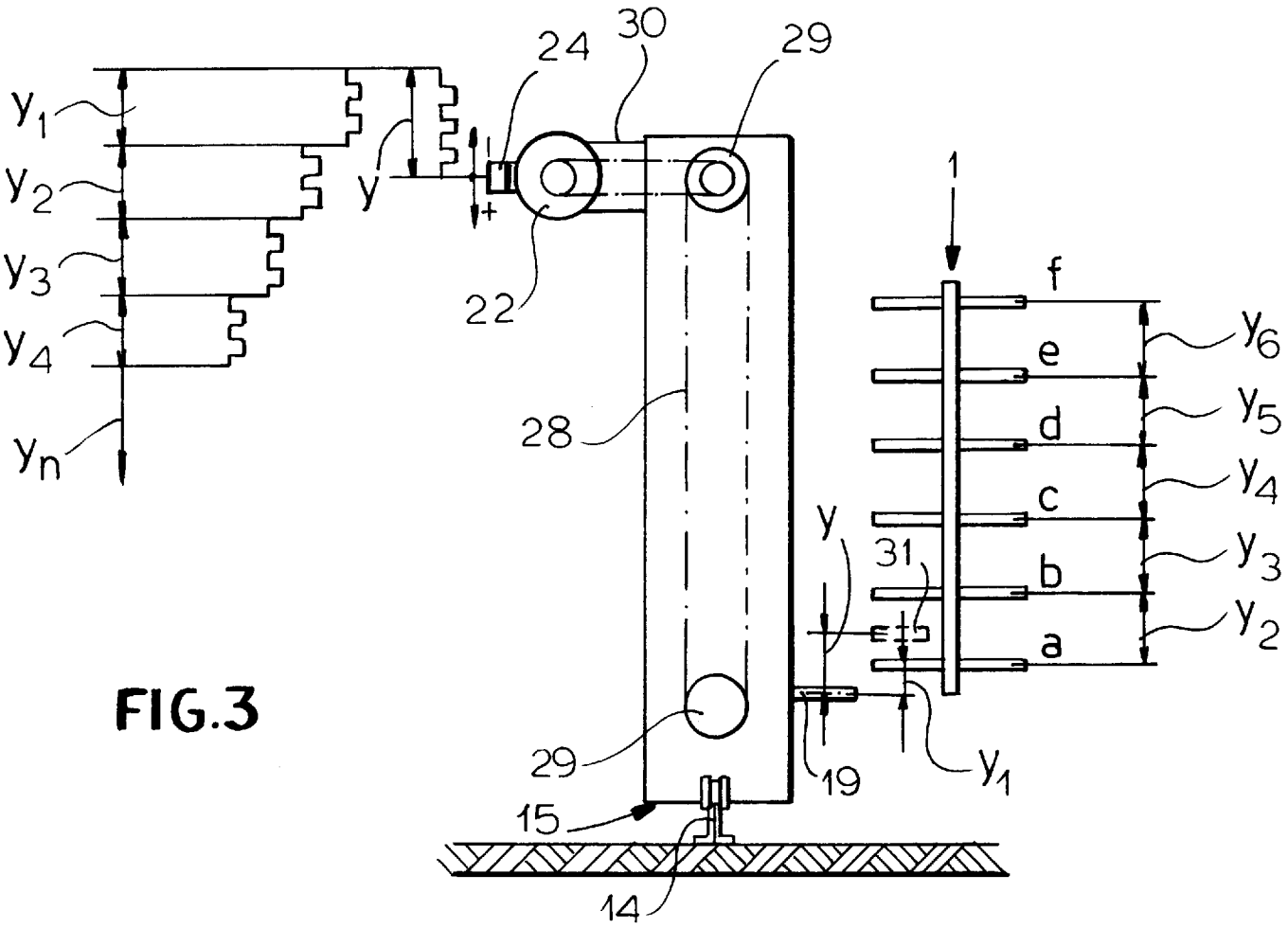
FIG. 3 is a side view of the transport carriage in schematic setting with respect to a vertical spool peg row.

FIG. 1 shows a rack 11 with spool pegs 10 arranged in tiers and rows for receiving spools, whose yarns are taken up in a manner known per se by a winding machine not shown in the drawing. Therefore there are horizontal peg tiers a, b, c, d, e, f, whose pegs 10 form on the other hand the vertical peg rows 1, 2 and 3. In order to load the pegs 10 with full yarn spools, when the yarns have been wound off the preceding spools, a transport carriage 15 is used which can travel back and forth on a rail between the rack 11 and the loading device 13, in the directions of the double arrow 32. In FIG. 3 a rail 14 is shown in cross section.

The transport carriage 15 has a chassis 25 with rollers 26, one of which is rotatably driven by a drive motor 23 via a belt drive 27. The chassis 25 has also several carriage pegs 16 arranged in a peg row one on top of the other. Flexible adjustment means 28, e.g. chain-driven support plates, are capable to displace the pegs 16 vertically, whereby the chassis 25 has guide rollers 29 at the top and at the bottom. A servomotor 22 is provided, which can adjust the pegs 16 by actuating the adjustment means 28 with a belt drive 30.

In order to insure that the carriage pegs 16 of the transport carriage 15 align precisely with a row 1 and so forth of the rack 11, it is required as a fundamental condition that the distances between the pegs 16 be equal to the distances between the pegs 10. If this is not the case, the spool carriage 15 has to be refitted for instance in the sense that the adjustment means 28 be replaced with others, which have pegs 16 with the required distances between them.

Figure 2:
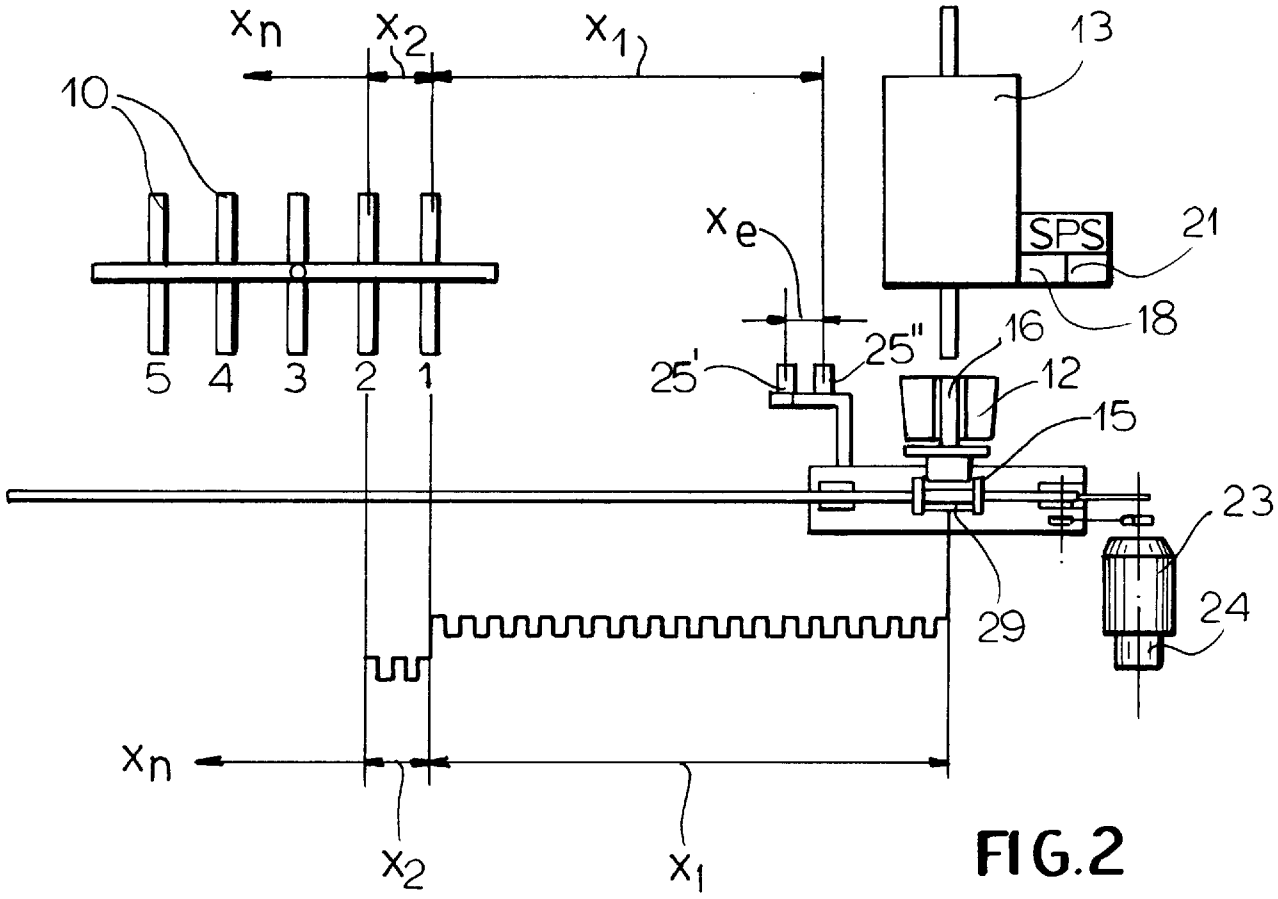
FIG. 2 is a top view of the rack and the transport carriage of FIG. 1, as well as of a loading device.

According to FIG. 2, the carriage 15 is in its zero position, which is defined with respect to the loading device 13. From this zero position the carriage 15 has to be moved by the drive motor 23 towards the rack 11, after it has been loaded with full yarn spools 12 by the loading device 13. It has to be stopped in front of the rack 11 so that its pegs 16 are aligned with the pegs 10 of the rack 11. In order to insure that this happens, the steering has to be influenced correspondingly and automatically, in order to achieve the desired positioning. For this purpose among others a stored program control SPS is used, which performs the control of the drive motor 23 in a conventional manner, which means via stored programs which control the course of the operation, namely the back and forth motion of the carriage 15, as well as, according to need, the take up of the full spools 12 from the loading device and the transfer of these full spools 12 from the transport carriage 15 to the rack pegs 10. In FIG. 2 the arrangement of the stored program control SPS t the loading device 13 is shown, in order to make clear that from here total control is exerted during loading. A stored program control can also be provided at the transport carriage, in order to steer the course of its movement and its operation. The loading function of the loading device 13 can also be influenced starting from the carriage, provided that it is not preferable to design the stored program control SPS of the transport carriage 15 as a carriage steering unit and to subordinate it to a monitoring stored program control of the loading device 13.

Provisions are made for the measuring of the horizontal positions of the transport carriage 15. This is performed with a sensor 25, which is mounted approximately at the height of peg tier b. It is preceded by a further sensor 25", which slows down the quick travel of the carriage 25 to positioning speed, when it is separated from the first peg row 1 of the rack 11 only by the travel distance $x_e$.

In order to determine precisely the position of the transport carriage 15 on the rail 14, and thereby in relation to the rack 11, the transport carriage 15, respectively its drive motor 23, has a high-resolution motion pickup 24, which is designed as an incremental motion pickup. When the transport carriage is moved by the drive motor 23 from the zero position in the direction of the rack 11, then according to FIG. 2 continuous increments are produced which characterize the respective position $x_n$ of the carriage 15. These increments are stored by a distance measuring instrument 18, so that the latter, respectively the control SPS, is always aware of the position of the carriage 15.

In order to steer the transport carriage 15 it is necessary to determine the positions of the transport carriage 15 with respect to the rack 11 relatively to the zero position. For this purpose a scaling trip of the carriage 15 is undertaken, during which the motion pickup 24 starting from the zero position gives increments, until the sensor reaches the peg row 1. Then the sensor 25" emits a signal in dependence of the travelled segment, which corresponds to the number of difference increments x1 between the loading device 13 and the first rack row 1, and is stored by the distance measuring instrument 18, optionally after an intermediate storage in the carriage 15. Correspondingly also the further spool rows 2 and so on can be accessed, in order to store sensor signals which correspond to them, depending on the travelled segments e.g. x2. After such a scaling trip the control SPS is capable to steer the drive motor 23 of the transport carriage 15 so that it reaches the its spool transfer positions in front of the spool rack 11 quickly and on target, without having to use the distance measuring instrument 18 for this purpose.

FIG. 3 shows that the transport carriage 15 has a servomotor 22 for the horizontal adjustment of the adjusting means 28, and thereby of the carriage pegs 16. On the servomotor 22 a high-resolution motion pickup 24 is mounted, which is designed as an incremental motion pickup. A vertically adjustable sensor 19 is provided and its signals can be stored by a vertical interval measuring instrument 21, which is provided on the loading device 13. This sensor 19 is set to the lowermost peg 31 of the loading device 13, as a reference point. Starting from this position wherein the sensor 19 is directly opposite to the spool peg 31, the vertical increments are scaled and correspondingly stored. The −/+ position indicated in the upper left side of FIG. 3 results, whereby first the negative increments are scaled when the sensor 19 moves upwards from its lowermost position indicated on the right bottom part of FIG. 3, whereby y1 is the number of increments from this lowermost position up to the position of the peg tier a of rack 11, while y is number of difference increments between this lowermost position and the reference point according to spool peg 31. The further increments y2 and so on describe the distances between the other peg tiers, eg.g. between tiers a and b. Trough a scaling trip in the direction y, starting out from the lowermost position of the sensor 19 one can determine, on the one hand, the relative height level of the peg tiers with respect to the reference point, as well as the distance of the peg tiers from each other. The setting of the carriage 15 has to be adjusted to the rack 11, according to need.

After the vertical profile of the rack 11 has been determined vertical interval measuring instrument 21, based on its measuring connection—not shown here—with the motion pickup 24, or an intermediate storage unit of the carriage 15, the stored program control which is operatively connected with the vertical interval measuring instrument 21 can influence the vertical position of the carriage pegs 16, after the full spools 12 have been transferred from the loading device 13 to the carriage 15. Then a one-time adjustment of the vertical position of the pegs 16 takes place, according to the results of the measurements effected during the scaling trip in $y_n$-direction, or each time a new adjustment from peg row to peg row, as far as this is required, for instance in racks with height-staggered spacing.

I claim:

1. An assembly for loading a plurality of spool pegs carrying full yarn spools, said device comprising:

an elongated horizontal rail;

loading means for loading the full spools;

transport means for receiving said full spools from said loading means and transporting the full spools along the rail, said transport means including:

a transport carriage on said rail, and drive means for displacing said carriage along a horizontal calibrated path;

a spool rack spaced downstream from said loading means and provided with a plurality of spaced apart rack pegs forming a plurality of parallel horizontal rows and parallel vertical columns;

distance measuring means operatively connected with said drive means for determining a position of said carriage along said calibrated path;

sensor means mounted on said transport carriage in a horizontal plane of one of said rows for generating a respective signal by each of the pegs in said one of said rows on said rack;

first storing means for storing said signals; and processing means operatively connected with said distance and sensor means for evaluating said signals and a position of said carriage along said path for aligning said carriage with full spools directly in front of a peg of said one row receiving a full spool.

2. The assembly defined in claim 1 wherein said drive means is provided with a respective incremental high-resolution motion pickup operatively connected with said processing means.

3. The assembly defined in claim 1 wherein said carriage is provided with a plurality of vertically spaced apart and adjustable carriage pegs receiving said full spools, said carriage further being provided with vertically adjustable detecting means for generating a respective carriage signal upon reaching each of the pegs forming a vertical column on said spool rack, second storing means for storing said carriage signals, servomeans operatively connected with said detecting means for vertically adjusting said carriage pegs in response to the respective carriage signals for transferring a full spool to a rack peg.

4. The assembly defined in claim 3 wherein said detecting means is actuated by said servomeans along with said carriage pegs, said servomeans being provided with a respective incremental high-resolution motion pickup operatively connected with said second storing means.

5. The assembly defined in claim 1, further comprising a stored program control mounted on the loading means.

6. The assembly defined in claim 1 wherein said sensor means includes downstream and upstream sensors mounted at a distance from one another less than a distance between adjacent rack pegs, said downstream sensor being operatively connected with said drive means for slowing down a travel speed of said carriage.

7. A process for loading full yarn spools on spool pegs spaced mutually apart and forming a plurality of horizontal rows and a plurality of vertical columns on a spool rack, said process comprising the steps of:

(a) loading full spools on superimposed horizontally arranged carriage pegs of a transport carriage;

(b) displacing said transport carriage from said loading device to the spool rack along a calibrated path;

(c) simultaneously with step (b) defining and storing incremental signals corresponding to a location of said transport carriage along said path;

(d) generating a plurality of subsequent decrete signals by sensor means mounted at a level of one row of said rack pegs and displaceable with the transport carriage and spaced downstream therefrom at a predetermined distance for defining the rack pegs upon passing of said transport carriage by the pegs;

(e) processing said signals and comparing the latter with signals corresponding to a relative position of said transport carriage to define a spool transfer position; and (f) shifting the carriage to said spool transfer position corresponding to alignment of said carriage pegs and said rack pegs.

8. The process defined in claim 7, further comprising the steps of:

generating a plurality of decrete signals corresponding to a vertical position of rack pegs forming a column by detecting means mounted vertically displaceable on said carriage;

storing said signals in relation to the intervals between the rack pegs; and adjusting vertically the carriage pegs for aligning the latter with said rack pegs in response to the signals corresponding to a vertical position of the rack pegs.

* * * * *